US005109637A

United States Patent [19]

Calafut

[11] Patent Number: 5,109,637

[45] Date of Patent: May 5, 1992

[54] ABRADING IMPLEMENT

[76] Inventor: Edward J. Calafut, 2590 Glenwood Rd., Vestal, N.Y. 13850

[21] Appl. No.: 619,743

[22] Filed: Nov. 29, 1990

[51] Int. Cl.[5] ..... B24D 15/04

[52] U.S. Cl. ..... 51/391; 51/401; 51/358

[58] Field of Search ..... 51/392, 393, 391, 400, 51/401, 404, 358, 363, 181 R, DIG. 14

[56] References Cited

U.S. PATENT DOCUMENTS

| | | | |
|---|---|---|---|
| 289,879 | 12/1883 | Almond | 51/392 |
| 2,347,856 | 5/1944 | Wachter | 51/392 |
| 3,280,517 | 10/1966 | Copeland | 51/404 |
| 3,284,963 | 11/1966 | Lanham et al. | 51/401 |
| 3,431,689 | 3/1969 | Schnabel | 51/400 |
| 4,314,426 | 2/1982 | Friend | 51/393 |
| 4,674,237 | 6/1987 | Sullivan | 51/401 |
| 4,951,423 | 8/1990 | Johnson | 51/358 |

FOREIGN PATENT DOCUMENTS

| | | | |
|---|---|---|---|
| 0635897 | 2/1962 | Canada | 51/404 |

*Primary Examiner*—Robert A. Rose
*Attorney, Agent, or Firm*—Kenneth P. Johnson

[57] ABSTRACT

Implement having a flexible core to which compressible, resilient and flexible fiber mats bearing fine abrasive material are secured to form a tool that can conveniently conform or coincide with convex, concave, flat or curved surfaces and to corners and crevices to enable improved, easier cleaning and smoothing of relatively soft greenware without damage to the surface. The tool can be an elongated member with parallel working surfaces or it can be a cylindrical, conical or other shape for adaptation to special requirements.

4 Claims, 1 Drawing Sheet

ABRADING IMPLEMENT

FIELD OF THE INVENTION

This invention relates generally to implements that remove material by abrasion and in particular, to hand tools for smoothing, cleaning or polishing unfired earthenware or porcelain.

BACKGROUND OF THE INVENTION

Ceramic craft objects such as porcelain or pottery are initially formed of uncured, compressed, dried clay known as greenware. These objects must be carefully handled because the formed clay has not been hardened or strengthened through firing. Frequently, the greenware objects carry surface defects that occur during handling or during formation in molds with poor definition. Those defects are best removed before curing while the molded material is relatively soft. The defects are often mold seam lines, minor grooves, ill-defined features or rough surfaces that can be readily sculpted, polished or cleaned to achieve the desired individual form characteristics.

Heretofore, cleaning and polishing tools for working unfired ceramics or greenware have been rigid implements with abrasive surfaces and held great potential for damaging the relatively soft unhardened clay body. Hand cleaning was frequently accomplished with metal abrasive tools such as sand paper files or abrasive-coated fibers adhered to a nonyielding or rigid base. Reciprocating or orbital motion of the tool in conjunction with excess pressure often gouged the surface of the article, resulting in a damaged or scrapped workpiece.

The rigidity, form and size of the known greenware finishing tools have lengthened preparation time of the workpiece because of the extensive care required and limited surface areas polished and cleaned. These tools do not conform to surface contours and thus produce small, high pressure points that produce excessive cutting or gouging.

OBJECTS AND SUMMARY OF THE INVENTION

It is accordingly a primary object of this invention to provide an abrasive hand tool for cleaning, polishing or modifying the surface of uncured clay bodies that possesses moderate stiffness yet conforms easily to the shape of the body surfaces to promote easier, faster and less damaging material removal.

Another important object of this invention is to provide abrasive cleaning and polishing implements for uncured molded clay workpieces that are flexible and resilient so as to conform to curved workpiece surfaces without creating high pressure points and thus avoid damage to the molded workpiece.

Still another object of this invention is to provide hand tools for shaping and cleaning molded uncured clay bodies in which the tools have a stiffening core and nonwoven resilient fibers with abrasive particles adhered thereon for achieving a contour-conforming abrading surface that reduces or eliminates the possibility of inordinate pressure on the uncured clay material that could produce fracture.

The foregoing objects are attained in accordance with the invention by providing an implement having core means of various flexible, resilient configurations each having a surface area to which abrasion means of nonwoven, matted fibers are attached that carry sharp-edged particles adhered thereon. The core configuration can, for example, be an elongate member with a large length to width ratio, circular, rectangular or square cross section and parallel major surfaces to which the abrasion means are affixed. Another alternative is to provide a conical substrate having on its outer surface a layer of abrasion fibers.

The flexibility and resiliency of the substrate or core means permit the implement to possess moderate stiffness and yet be temporarily bent to conform to workpiece surfaces for cleaning or shaping. Abrasion means of nonwoven, matted abrading fibers adhered to the substrate surface provides secondary resilience to the implement enabling a wide range of pressure on work surfaces that may include uncured clay, fired ceramics of pottery or porcelain or the like. Further resilience can be obtained by interposing a layer of closed polymeric foam material between the core substrate and fiber mat.

A lightweight tool is disclosed that lends itself readily to polishing, cleaning or forming fragile workpiece surfaces unable to withstand inadvertent large forces that can be present with a rigid implement.

DESCRIPTION OF THE PREFERRED EMBODIMENTS

Figure 1:
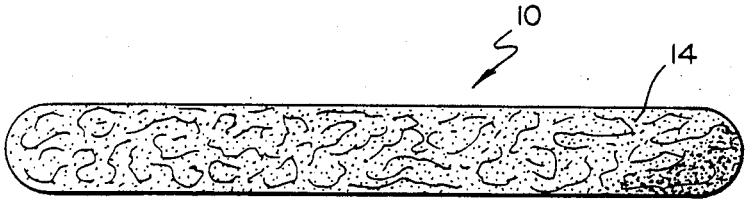
FIGS. 1, 2 and 3 are respective plan, end and elevation views of an abrading implement constructed in accordance with the principles of the invention.
Figure 2:
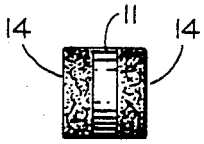
Figure 3:
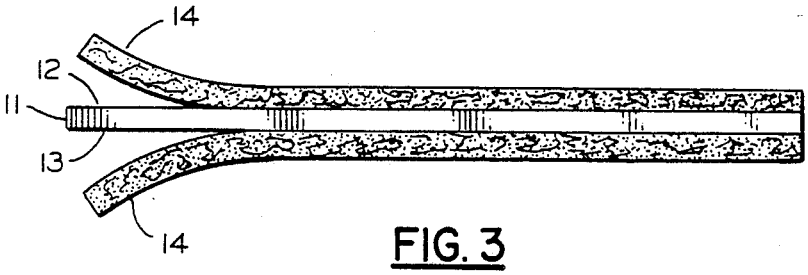

Referring to FIGS. 1, 2 and 3, the abrading implement 10 of the invention comprises a substantially planar core 11 having major opposite surfaces 12 and 13 to which are secured respective layers 14 of nonwoven fiber pad or mat of substantially uniform thickness with the fibers of each layer having abrasive particles such as aluminum oxide or emery grit bonded thereto. Core 11 is preferably formed of a yieldable, resilient polymeric material such as polyvinyl chloride or polyurethane. It can be a solid, fiber reinforced or foam material that has moderate stiffness or resistance to deflection. As an example of preferred yielding or bending, a strip of material three quarters inch wide, 0.0625 in. thick, extending cantilever fashion from a fixed base, should show a deflection of 0.25 to 0.5 in. two inches from the fixed base under a three ounce load at the free end. Materials having more or less rigidity beyond this range can also be used, however. The supporting core material should offer enough resistance that the attached abrasive layers are effective to remove seams, lumps and imperfections in uncured or green ceramic ware or porcelain but have sufficient flexibility to avoid gouging the greenware.

Abrasive fiber layers 14 are secured to the two major external, opposite surfaces 12 and 13 of core 11 by any suitable adhesive and comprise randomly matted, but nonwoven fibers of a polymer, such as nylon, to which any of various abrasive particles are adhered by organic glue or resin. The particles are preferably of a substantially uniform diameter that lies in the range of 200-600 (75-15 microns) grit size. The matted, but unwoven fibers, provide compressibility and resilience in use that permits accurate, gradual shaping of uncured ceramic or low-fired procelain materials. These mats avoid the potential for a damaged work surface that is present and likely with the more rigid tools of files, emery boards or scrapers. The two fiber layers 14 may be coated with abrasive particles of different grit sizes, color coded for convenience, to provide coarse and fine surfaces to suit the user. An example of abrasive matted fibers 14 are the "Scotch Brite" surface conditioning products available from the 3M Company, St. Paul, Minn. 55144.

Figure 4:
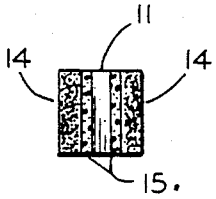
FIG. 4 is an end view of an implement shown in FIGS. 1-3 but illustrating a modified core construction.

In an alternative construction shown in FIG. 4, layers 15 of polymeric foam material are adherred by adhesive to surfaces 12 and 13 when a non-cellular core 11 is used. Mat layers 14 are then adhesively attached to a respective one of the foam layers. This assembly adds resilience to the abrading layers 14 and promotes adhesive bonding of the fiber mats at the foam-mat interface.

Figure 5:
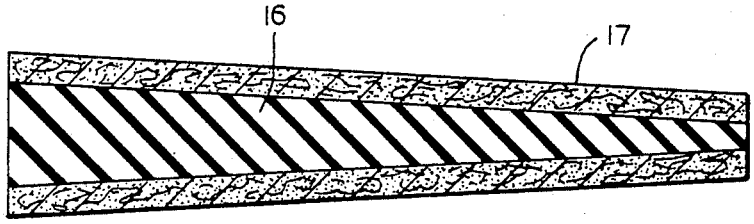
FIGS. 5 and 6 are respective sectional and end views of an abrading tool of the invention having a conical shape.
Figure 6:
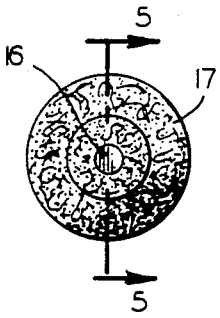
Figure 7:
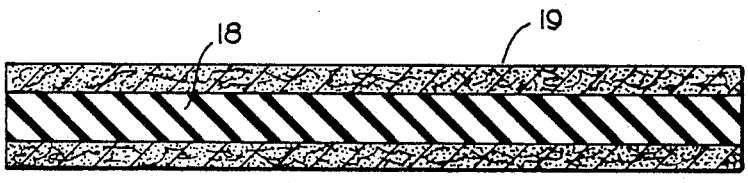
FIGS. 7 and 8 are respective sectional and end views of a cylindrical form of the abrading tool of the invention.
Figure 8:
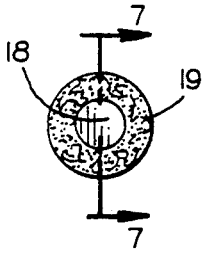

Alternative embodiments of the invention enable the smoothing of curved or cylindrical surfaces and are shown in FIGS. 5-8. In FIGS. 5 and 6, a conically shaped abrading tool is shown that comprises conical core 16 having attached to its curved surface nonwoven abrading fiber mat 17. The tapered shape of the tool permits polishing and smoothing openings and concave depressions of varying sizes. In FIGS. 7 and 8, a cylindrical tool is shown having a core 18 of uniform diameter whose cylindrical surface has adhered thereto a layer 19 of the resilient abrasive mat fibers. The preference of the tool shape is determined by the user and demands of the task. The abrading mat fiber layers 17 and 19 can be the same materials as those described with respect to the embodiment shown in FIGS. 1-3. The conical and cylindrical tools in FIGS. 5-8 are preferably constructed by first inserting the mat layers 17 and 19 as the liners in a mold and the pouring into the center a liquid mixture of a polymeric foam material such as polyurethane or silicone rubber or the like, letting it cure, then ejecting the completed tool.

The embodiments of the abrading implement as described above can be formed in other configurations as required by the needs of the artisan. It has been found that those configurations shown meet most of the requirements experienced. Overall tool length of seven inches, width of three-quarters of an inch to one inch and thickness of one-half to three-quarters of an inch, in the case of the device shown in FIGS. 1-3, are the approximate dimensions that have been found most convenient. Tool dimensions for the embodiments in FIGS. 4-8 can vary depending on the opening sizes and curvature radii of the workpieces. Tool length, width and diameters can vary by approximately 33% while still retaining its convenience and effectiveness. Handles may be attached to or formed integrally with the cores for convenience, if desired.

While the invention has been particularly shown and described with reference to preferred embodiments thereof, it will be understood by those skilled in the art that changes in form and details may be made therein without departing from the spirit and scope of the invention.

What is claimed is:

1. An abrading implement comprising:

core means of a first material of substantially solid composition that is a flexible and resilient polymer with a pair of major opposite, planar surfaces;

a layer of a second material secured on each said major surface having a foam composition that is a flexible and resilient polymer; and a compressible mat of unwoven polymeric fibers affixed to each said layer with said fibers having adhered thereto abrading particles.

2. The implement as described in claim 1 wherein the grit size of said particles on said fibers of each of said mats is of a different substantially uniform grit size and lies in the range of 15 to 75 microns.

3. An abrading implement comprising:

core means of a polymeric, flexible resilient material having at least one pair of major planar surfaces;

a layer of closed cell, polymeric foam material secured to each said major surface; and a mat of nonwoven, flexible polymeric fibers affixed to at least one said layer with the fibers in the mat having adhered thereon particles of abrasive materials having a substantially uniform grit size in the range of 15 to 75 microns.

4. The implement as described in claim 3 wherein each said layer has affixed thereto a said mat of fibers and the abrasive materials adhered to the fibers of one said mat differ in size uniformity from those adhered to the fibers of the other of said mats.

* * * * *